US006321848B1

(12) United States Patent
Funk

(10) Patent No.: US 6,321,848 B1
(45) Date of Patent: Nov. 27, 2001

(54) METHOD OF AND APPARATUS FOR INSERTING TUBING INTO A LIVE WELL BORE

(76) Inventor: Kelly Funk, 301 Mount Royal Place, Nanaimo, British Columbia (CA), V9R 6A4

( * ) Notice: Subject to any disclaimer, the term of this patent is extended or adjusted under 35 U.S.C. 154(b) by 0 days.

(21) Appl. No.: 09/573,232

(22) Filed: May 18, 2000

Related U.S. Application Data

(60) Provisional application No. 60/134,838, filed on May 19, 1999.

(51) Int. Cl.[7] ..... E21B 23/08
(52) U.S. Cl. ..... 166/383; 166/77.2
(58) Field of Search ..... 166/380, 381, 166/383, 77.2

(56) References Cited

U.S. PATENT DOCUMENTS

| | | | |
|---|---|---|---|
| 3,467,196 | 9/1969 | Kinsman . | |
| 3,506,068 | 4/1970 | Brown et al. . | |
| 5,568,837 | 10/1996 | Funk . | |
| 5,988,274 * | 11/1999 | Funk | 166/77.4 |

FOREIGN PATENT DOCUMENTS 1132503 11/1968 (GB) .

* cited by examiner

*Primary Examiner*—William Neuder

(57) ABSTRACT

A method of and apparatus for inserting tubing into a well bore by supplying a leading end of a well bore tubing towards the well bore, with a piston on the leading end of the well bore tubing; and supplying fluid under pressure to the piston to force the piston and the leading end of the well bore tubing downwardly into the well bore.

10 Claims, 1 Drawing Sheet

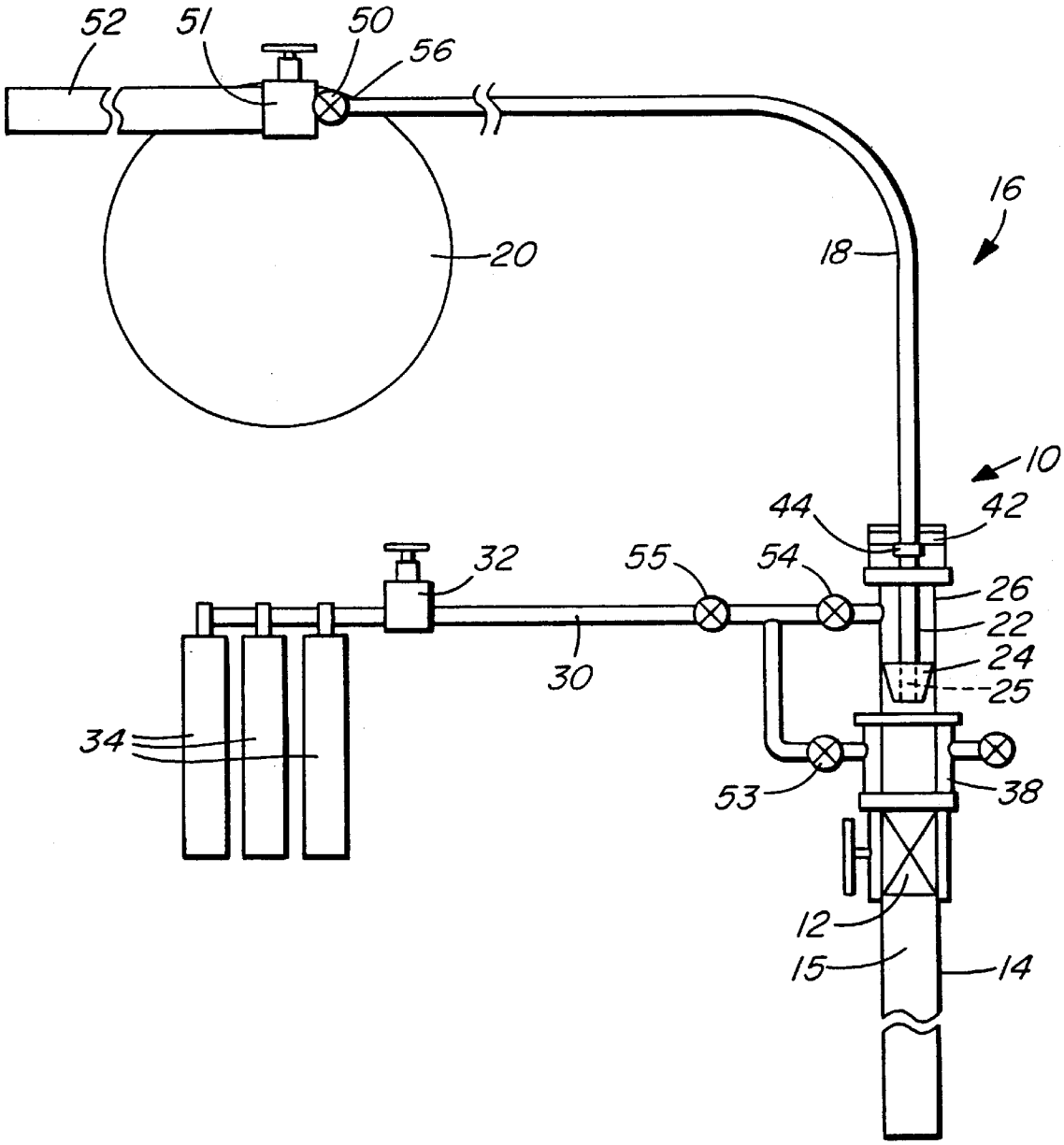
52
51
50
56
16
20
18
10
44
42
32
55
54
26
22
24
25
30
34
53
38
12
15
14

METHOD OF AND APPARATUS FOR INSERTING TUBING INTO A LIVE WELL BORE

This application claims benefit to U.S. provisional application Serial No. 60/134,838, filed May 19, 1999.

BACKGROUND OF THE INVENTION

1. Field of the Invention

The present invention relates to methods of inserting tubing into a well bore and to well head apparatus for performing such methods and is useful for the insertion of continuous tubing, e.g. of plastic, and of coupled tubing sections into live well bores.

2. Description of the Related Art

One of the differences between running coil tubing and coupled tubing into a well head is typically the way the well head is configured. Because it is usually predetermined that coil tubing is going to be installed into the well instead of coupled tubing, a full opening closure is installed at the surface to the top of the casing of the well bore before the well is perforated. The closure installation is generally consistent with coupled tubing live well installations, with the difference typically but not always being the type of closure. The closure may vary in size and configuration from a standard valve to any suitable well control device, e.g. a blow out preventor. The closure is dependent on the well application, with a typical prerequisite being full opening consistent with the inside diameter of the well casing or the largest size of any tool or mechanism that may be installed within the well head assembly, e.g. the tubing hanger assembly.

Once the well has been perforated, the full opening closure is closed so as to maintain the well pressure below the closure. A well head which is designed to hang or suspend coil tubing may be installed on top of the casing, after or prior to perforating the well, and below the full opening closure, once again depending on the application, the closure therefore being located above or below the wellhead. The well head is generally much the same as any conventional well head, with typical outlets and valves on opposing sides to allow access to the annulus (i.e. the space between the tubing and the casing) as may be necessary to deal with any particular well. The well head may also have a sealing device incorporated into the body of the head to allow movement of the tubing while maintaining well bore pressure.

Most coil tubing installed into wells today is steel and is injected into the well with a hydraulically activated injector head that has two opposed rolling surface areas that effectively push the tubing into the well from above the well head, using friction to ensure control and movement of the tubing into the well bore and thereby exerting compressive forces on the tubing. This process is very expensive because of the cost of the steel tubing and also because it requires the use of elaborate and therefore expensive equipment.

Plastic tubing, which is very inexpensive compared to steel tubing, has been inserted into wells using the same apparatus, but is limited to use with low well bore pressures because of the risk of buckling and collapsing in response to the compressive forces acting on the plastic tubing.

Another factor with the use of coil tubing in well applications is the difficulties encountered with depth measurement relating to the leading end of the tubing. The tendency for coil tubing to remain in a semi-coiled state in the well bore because of residual memory, resulting from the tubing being installed from a round spool, and also surface contact friction encountered as the tubing lays against the walls of the well casing increase friction, thereby making insertion into the well bore more difficult, increasing the potential for buckling and making depth measurement very inaccurate.

BRIEF SUMMARY OF THE INVENTION

According to the present invention, there is provided a method of inserting tubing into a well bore which comprises the steps of supplying a leading end of a continuous length of well bore tubing from a coil of such tubing towards the well bore, providing on the leading end a piston, and supplying gas or fluid under pressure to the piston to thereby force the piston and the leading end downwardly into the well bore.

By the present invention, therefore, the tubing is pulled downwardly into the well bore by the piston on the leading end of the tubing and the tubing is subjected to tensile forces instead of the compressive forces which were exerted on the tubing in the above-discussed prior art method. This is particularly advantageous when plastic well bore tubing is employed.

Also according to the present invention, there is provided a method of inserting tubing into a well bore which comprises the steps of inserting the piston on a leading end of the tubing into a conduit above the well head and supplying gas under pressure from a compressed gas source above the piston to thereby force the piston and the leading end of the tubing downwardly into the well bore.

Preferably, a closure and flow regulating device, e.g. a pressure regulator or choke, is installed on a trailing end of the tubing intended for installation, and fluid displaced below the piston is allowed to flow upwardly through the tubing at a controlled rate corresponding to the displacement and pressure of the well bore. By allowing the fluid displaced below the piston to flow upwardly through the tubing, the fluid, which may be gas, in the well is prevented from being pushed back into the formation, which would have undesirable effects on the well (depending on the sensitivity of the well formation) and production.

By maintaining consistent and close to equal pressures between the inside and outside of the tubing, collapse of the tubing is prevented. With the use of plastic tubing the performance properties of the tubing are such that the tubing would otherwise allow only a relatively low external pressure before the well pressure forces would compress the exterior wall of the tubing to an undesirable point of collapse. By maintaining a pressure inside the tubing the external forces from the pressure of the well can be counteracted.

With equal pressures or moderate differential pressures on the internal and external surface of the walls of the tubing, remaining within the scope of the collapse performance of the tubing, the tubing can be installed into wells with much higher pressures than would otherwise be possible.

Once he tubing has reached the desired depth in the well, the closure at the trailing end of the tubing is closed and the tubing is then landed into the receiving well head while constantly maintaining pressure inside the tubing and thereby not allowing it to collapse.

The methods and apparatus according to the present invention thus address and prevent issues and restrictions incurred with the use of conventional methods and equipment while installing tubing into live well bores. The displacement and collapse issues with the use of plastic coil tubing, as well as buckling and depth measurement associated with tubing being inserted or hanging in a well, are eliminated. Another advantage to the present invention is that the tubing can be left in tension while suspended in the well by employing the piston at the leading end of the tubing and thereby pulling the tubing into the well bore. Hydrocarbons from the well are never introduced to equipment above the well head and are immediately displaced into the well bore followed by an inert fluid or gas above the piston, making the present method and apparatus much safer in the event of human error or equipment failure than prior art methods used today.

In a preferred embodiment of the invention, a wellhead assembly is installed above a closure and the closure is closed to maintain pressure in the well bore. The leading end of the tubing is then introduced together with the piston into a cylindrical tube, and gas under pressure, from a pressured vessel is introduced into a passage within the cylindrical tube either above and/or below the piston while the tubing is secured to prevent movement of the piston and the tubing. The pressures above and below the piston are thus equalized.

Further gas under pressure is then introduced into a passage above the piston to effect the forcing of the piston and the leading end of the tubing into and down the well bore.

Additional benefits of the present invention are that the use of fluid pressure above the piston to pull the tubing into the well bore counteracts the residual semi-coiled effects discussed above and the friction associated with that effect, and allows accurate depth placement of the tubing in the well. This method keeps tubing straighter, since the tubing is in tension rather than in compression while being pulled into the well bore.

The tubing can be landed into the well head, under tension, using various types of tools, e.g. slips, grapples or collar stops, to secure the movement of the leading end of the tubing once the tubing has been landed into the well head by applying pressure to the top of the piston.

The well assembly may also include an equalizing duct or ducts communicating from the well bore through the well head to a portion of the cylindrical tube and blow out preventors with equalizing and bleed-off facilities.

The tubing installation assembly may also include an equalizing duct or ducts communicating from the pressurized gas vessels through the well head to a portion of a cylindrical tube or tubes and/or a blow out preventor configuration with equalizing and bleed-off facilities between each blow out preventor (not shown). These equalizing duct(s) are provided to allow pressure equalization between the well bore and or any portion of the cylindrical tube(s) and associated well control equipment used in the well application. The equipment and configuration possibilities used are endless and will vary from well to well depending on the application. Factors will include the well type, e.g. gas or oil, pressures, tools and surface equipment, e.g. well head, being used in or on the well etc.

The present invention still further provides an assembly comprising a closure installed on top of the landed or secured column or casing and a well head installed above or below the closure, the tubing installation assembly comprising a cylindrical tube, a coil tubing supply system, tubing sealing devices and tubing securement device or devices located above, below or inside the cylindrical tube and pressurized gas inlets communicating with the interior of the cylindrical tube, valves to isolate and allow flow, pressure and flow regulating devices which are self explanatory.

BRIEF DESCRIPTION OF THE DRAWING

The present invention will be more readily apparent from the following description of a preferred embodiment thereof shown in the accompanying drawing, which diagrammatically illustrates a well head installation in which the present method is performed.

DESCRIPTION OF THE PREFERRED EMBODIMENT

In the accompanying drawing, there is shown a tubing installation assembly indicated generally by reference numeral 10 which is installed on a full opening closure in the form of a valve 12 which, in turn, is installed at the top of a well bore casing 14.

The tubing installation assembly 10 includes a system, indicated generally by reference numeral 16, for supplying a continuous plastic coil well bore tubing 18 to the well bore 15 from a spool 20.

The tubing 18 has a leading end 22 on which is provide a piston 24, which is dimensioned to fit snugly into a cylindrical tube 26, forming part of the tubing installation assembly 10. A passage 25 extending through the piston 24 communicates with the interior of the tubing 18. The tube 26, the valve 12 and the well bore casing 14 in the tubing installation assembly 16 have internal diameters which are generally equal to one another and close to the diameter of the piston 24.

A compressed air duct 30, provided with a pressure regulator 32, connects compressed gas tanks 34 to an upper portion of the interior of the cylindrical tube 26. Another gas duct 36, serving as an equalization duct, interconnects a well head 38 below the cylindrical tube 26 to the duct 30 and, thus, to the upper portion of the cylindrical tube 26. The well head 10 also has a sealing device 42 for sealing the tubing.

The sealing device 42 is associated with a tubing securement device 44 for securing the tubing against movement caused by hydraulic forces from the well bore pressure, the tubing securement device 44 comprising a retainer ring located under the sealing device 42 and extending around the tubing 18 to secure the tubing 18 against upward movement and to allow downward movement of the tubing 18 when required.

The valve 12, in this embodiment, is a full open valve of a type which is designed, through mechanical activation (typically, but not always, a ¼ over-turn), to allow gas to pass through an internal port typically in the form of a passage or small orifice (not shown) which allows for pressure equalization, as explained below. The purpose of this orifice is to prevent the washing out or potential erosion effects that gas or fluid may have on the valve gate, which might cause it to fail after repeated opening and closings of the valve with well pressure on one side and no pressure on the other.

The valve 12 which is installed on the well casing 14 before the well is perforated, is closed to maintain the well pressure below the valve 12. The well head 38 is then installed on the valve 12 and the tubing installation assembly 10 is subsequently installed on the well head 38.

To insert the tubing 18, the piston 24 is secured to the leading end 22 of the tubing 18 and the leading end 22, with the piston 24, are inserted into the tube 26 into the positions in which they are shown in the drawing, together with the securement device 44. The sealing device 42 is closed around the tubing to seal the tubing 18 to the tube 26 and thereby to seal the well bore pressure 15 inside the tubing installation assembly 10. A valve closure 50 and flow regulating device 51 are installed on a trailing end 56 of the tubing 18, which is connected to a flow duct 52.

Gas is released from the containers 34 at a controlled pressure, regulated by a pressure control device 32 into the ducts 30 and 36 and through the open valves 53, 54, 55, which provides pressure into the passage below the sealing device 42 through the cylindrical tube 26 and the well head 38 to the top of the valve 12 and around both sides of the piston 24, thus equalizing the pressures inside the tubing 18, to the trailing end 56 of the tubing, where the valve 50 is closed, and any passage above the valve 12, with that of the well bore.

The valve 12 is then opened to allow the piston 24, with any associated tools (not shown) and the leading end 22 of the tubing 18 to be inserted into the well bore 15 and the valve 53 is closed.

Additional pressure is then supplied by the compressed gas in the gas tanks 34, through the duct 30, the valve 55, 54, under the control of the pressure regulator 51, into the upper portion of the cylindrical spool 26 above the piston 24 in order to force the piston 26 and tubing 18 downwardly through the well head 38 and the open closure 12 into the well bore.

The valve 50 may now optionally be opened and the pressure regulator 51 adjusted to regulate the pressure and flow of the well while the piston 24 and tubing 18 are pulled into the well bore 15 to allow for the displacement of well fluid or gas from below the piston 24 upwardly through the piston passage 25, through the tubing 18, the valve 50 and the pressure regulator 51 and out through the flow duct 52.

Because the plastic tubing 18 is thus pulled under tension, instead of being pushed down the well bore 14 under compression, it is possible to install the tubing 18 into wells having much higher well pressure than would be possible with the prior art method described above.

In addition, it is also possible to flow fluid from the well up through the passage 25 extending through the piston 24 and through the tubing 18 while maintaining the pressurized state of the tubing 18 to counteract collapse of the tubing 18 in high-pressure applications, as described above.

As will be apparent to those skilled in the art, various modifications may be made to the above-described method and apparatus within the scope of the present invention.

For example, instead of employing compressed gas from compressed gas tanks to force the piston into and down the well bore, it is alternatively possible to employ a pump (not shown) connected to the duct to provide the required pressure in the upper portion of the casing 18. Also, instead of connecting gas under pressure from the gas tanks 34 to the tubing installation assembly 10 as described above, the gas pressures above and below the piston could be provided from the well pressure to equalize the pressure on opposing sides of the valve 12. The preferred method as described above prevents the possible escape of any hydrocarbons from above the valve 12 since the hydrocarbons can always be blanketed with an inert fluid such as nitrogen or water.

Also, and dependent on the well and application, the well head 38 could be installed on top of the casing 14 and the cylindrical tube 26 with well control devices, e.g. blow out preventors, on top of the cylindrical tube 26, with sealing devices, e.g. annular blow out preventors, with additional cylindrical tubes and equalizing and bleed off ducts in any configuration necessary to accommodate the installation of any type of tubing, pipe and/or tools intended to be installed or removed from a live well, may be installed on the well head 38. The cylindrical tube 26 may be replaced by a telescopic tube to assist in providing a cavity or chamber to house or lubricate tools being installed into the well, as described in my U.S. Pat. No. 5,988,274, issued Nov. 23, 1999.

By providing sealing devices below and above the cylindrical tube, conduit or telescopic chamber and closing them around the outside of the tubing, pressure can be bled off above the valve 12.

The upper sealing device can then be opened and the telescopic chamber extended to provide an enlarged chamber for receiving the tools. The upper sealing device is then closed, the pressure is equalized between the upper and lower sealing devices and the well bore and the lower closure is opened. Upper and lower ends of the telescopic chamber can additionally be fitted with securement devices to hold the tubing from movement and to additionally raise, lower, push or pull the tubing into or from the well if necessary.

Alternatively, the well head can be installed on top of the well casing 14, the cylindrical tube 26 installed above the well head 38 and a valve or blind ram blow out preventor (not shown) installed above the cylindrical tube 26. The well is then perforated and the valve is closed to secure the well bore pressure 15. The tubing installation assembly 10 is then installed on top of the valve or blow out preventor (not shown). When the tubing 18 has been installed into the well bore and landed into the well head 38, the valve 12 or blow out preventor (not shown) is removed, leaving only the well head 38 above the casing 14.

By employing spools, ducts, valves, closures pressure regulators, tubing securement devices, sealing devices and blow out preventors on the well and by using fluid from the well, or additional fluid pressure to maintain pressure on top of the piston while simultaneously controlling the flow displaced by the piston through the annulus, the above-described procedures may be reversed methods from this patent to remove the tubing 18, pipe and/or tools from the well while maintaining well pressure. When the present invention is employed to insert coupled tubing sections (not shown) instead of continuous tubing into the well bore, the tubing securement and sealing devices may be replaced by conventional slips and blow out preventors in various configurations.

A further possibility is to install a plurality of pistons on to the leading end of the tubing, with various spacings between them to facilitate maintenance of a nominal bore throughout the tubing installation assembly 10, well head and well control equipment, e.g. blow out preventors. With this type of configuration, any one of the pistons maintains a positive seal with pressure above while one or more upper or lower one of the pistons passes through a section or sections within the configuration where a seal cannot be maintained.

Also when the well control equipment and tubing installation assembly are configured in such a way that it would not be practical to equalize pressure from below the piston, e.g. if there are no equalizing ducts above or below the piston, pressurized fluid or well pressure can be used or injected from the trailing end of the tubing and discharged from the leading end. For example, it is possible to connect a duct from the well head casing valve or the pressurized gas tanks to the trailing end of the tubing. Gas or fluid under pressure could then be passed from the well bore or from pressurized gas tanks through the tubing to the leading end to equalize or energize a space directly above or below the piston where there is no other point of access.

Also, the piston may be resiliently deformable to allow the pressures immediately above and below the piston to be equalized through deformation of the resilient piston. In this case, pressure from below the piston migrates upwardly past the piston to a cavity space above the piston.

A standard piston is intended to hold pressure only from above, although different pistons such as double-acting holding pressure from both sides) may be employed in various applications and configurations.

Piston assemblies may also employ a combination of standard single acting pistons in combination with double acting pistons. Single acting pistons can be inverted to oppose one another, whereby pressure and forces could be maintained above or below the pistons to assist in any application, e.g. for removal of steel coupled tubing from a well bore or to set a tubing string in compression in the well bore.

Instead of employing tubing made of a single plastic material, it is alternatively possible to use composite tubing made from various materials, for example polyamides and other plastic materials, fiberglass etc., particularly in deep wells where strength is important. Suitable composite tubing will withstand high external and internal pressures and can be inserted into deep wells. Also, when using suitable composite tubing, it may not be necessary to maintain pressure within the tubing provided that the tubing has sufficient strength to avoid collapsing of the tubing.

I claim:

1. A method of inserting tubing into a well bore, which comprises the steps of:

supplying a leading end of a well bore tubing towards said well bore;

providing a piston on said leading end of said well bore tubing;

supplying fluid under pressure to said piston to force said piston and said leading end of said well bore tubing downwardly into said well bore; and providing a pressure regulator at a trailing end of said well bore tubing and employing said pressure regulator to control a flow of fluid under pressure from said well bore through said well bore tubing.

2. A method as claimed in claim 1, in which said tubing is plastic and in which the step of supplying the leading end of said tubing comprises feeding said tubing from a coil of said tubing.

3. A method as claimed in claim 1, which includes inserting said piston on said leading end of said well bore tubing into a tube above a well head, sealing said tube into said well bore tubing above said piston, opening a closure in said well head below said piston to expose said piston to the well pressure of said well bore below said piston, and applying pressure to said piston above said piston to force said piston and said leading end of said well bore tubing downwardly from said conduit, through said well head and into said well bore.

4. A method as claimed in claim 3, in which said tubing is plastic and which includes employing said pressure regulator to maintain within said well bore tubing an internal pressure sufficient to prevent collapse of said well bore tubing by external pressure acting on the exterior of said well bore tubing.

5. A method as claimed in claim 3, which includes closing the trailing end of said well bore tubing to terminate discharge of pressure through the trailing end of said well bore tubing when said well bore tubing has been inserted to a desired depth in said well bore.

6. A method as claimed in claim 1, which includes connecting well bore pressure from said well bore to said piston above said piston to thereby equalize pressures acting downwardly and upwardly on said piston.

7. Apparatus for inserting well bore tubing into a live well bore through a well head, comprising a piston on a leading end of said well bore tubing; a tubing installation assembly on said well head, said tubing installation assembly including a tube for receiving said piston and the leading end of said well bore tubing, and a sealing device for sealing said tube to said well bore tubing above said piston; a source of fluid under pressure; a duct connecting said pressure fluid source to said tube at a location above said piston and below said sealing device and a pressure regulator controlling the flow of fluid under pressure through said duct to said tube.

8. Apparatus as claimed in claim 7, including a by-pass duct connecting said well bore to said tube.

9. Apparatus as claimed in claim 7, including a passage through said piston, said passage connecting said well bore to the interior of said well bore tubing, and a trailing end pressure regulator on a trailing end of said well bore tubing, said trailing end pressure regulator controlling the discharge of pressure from the interior of said well bore tubing.

10. Apparatus as claimed in claim 9, including an adjustable closure at the trailing end of said well bore tubing for selectively preventing the discharge of pressure from the interior of said well bore tubing.

* * * * *